US008315551B2

(12) United States Patent
Kim et al.

(10) Patent No.: US 8,315,551 B2
(45) Date of Patent: Nov. 20, 2012

(54) IMAGE FORMING APPARATUS WHICH PREVENTS A GUIDE MEMBER FROM INTERFERING WITH THE DISCHARGE OF A RECORDING MEDIA

(75) Inventors: Jun Won Kim, Seongnam-si (KR); Jae Ho Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 369 days.

(21) Appl. No.: 12/685,779

(22) Filed: Jan. 12, 2010

(65) Prior Publication Data

US 2010/0178092 A1 Jul. 15, 2010

(30) Foreign Application Priority Data

Jan. 12, 2009 (KR) ..... 10-2009-0002312

(51) Int. Cl.
*G03G 15/00* (2006.01)
*B65H 29/66* (2006.01)

(52) U.S. Cl. ..... 399/405; 399/401; 271/65

(58) Field of Classification Search ..... 399/405, 399/401; 271/65
See application file for complete search history.

(56) References Cited

U.S. PATENT DOCUMENTS 6,553,207 B2 * 4/2003 Tsusaka et al. ..... 399/401
7,079,806 B2 * 7/2006 Baek et al. ..... 399/405
7,290,952 B2 * 11/2007 Kagami ..... 400/693

FOREIGN PATENT DOCUMENTS

KR 2004-0009884 1/2004

* cited by examiner

*Primary Examiner* — Judy Nguyen
*Assistant Examiner* — Blake A Tankersley
(74) *Attorney, Agent, or Firm* — Stanzione & Kim, LLP

(57) ABSTRACT

An image forming apparatus includes a main body, an auxiliary discharging part disposed at one side of the main body, a cover unit to open and close the auxiliary discharging part and stack thereon paper discharged through the auxiliary discharging part, a guide member rotatably mounted to the cover unit to guide the paper when the paper is rotating, and a supporting device to support the guide member when the auxiliary discharging part is in an opened state. Since the supporting device supports the guide member when the auxiliary discharging part is in an opened state, paper being discharged through the auxiliary discharging part may be stably stacked on the cover unit, being prevented from interfering with the guide member.

18 Claims, 5 Drawing Sheets

IMAGE FORMING APPARATUS WHICH PREVENTS A GUIDE MEMBER FROM INTERFERING WITH THE DISCHARGE OF A RECORDING MEDIA

CROSS-REFERENCE TO RELATED APPLICATIONS

This application claims priority under 35 U.S.C. §119(a) from Korean Patent Application No. 2009-2312, filed on Jan. 12, 2009, in the Korean Intellectual Property Office, the disclosure of which is incorporated herein by reference.

BACKGROUND

1. Field of the Invention

The present general inventive concept relates to an image forming apparatus having an auxiliary discharging part which guides a paper being discharged so that an image-formed side of the paper is directed upward, and a cover unit that opens and closes the auxiliary discharging part.

2. Description of the Related Art

In general, an image forming apparatus produces an image on a paper according to image signals being input. Printers, photocopiers, facsimiles, and a multifunctional apparatus combining functions of the above are included in the image forming apparatus.

The image forming apparatus generally includes a main body constituting an exterior appearance thereof, a paper feeding unit storing plural sheets of paper therein, a developing unit forming a visible image on a paper supplied from the paper feeding unit using developer, a fixing unit fixing the developer image on the paper, and a paper discharging unit discharging to an outside the paper whereon image formation is completed.

A paper stacking unit is formed at one side of an upper part of the main body, including a discharging part at one side thereof to discharge the image-formed paper therethrough.

If, for example, a relatively thick recording medium, such as an envelope, is discharged to the paper stacking unit through the discharging part, the paper may be creased while being fed from the fixing unit to the discharging part. To this end, an auxiliary discharging part is additionally provided at a rear side of the main body to guide the paper passed through the fixing unit to be discharged to an outside to maintain its posture. A cover unit is also formed at the auxiliary discharging part to open and close the discharging part.

When the auxiliary discharging part is in a closed state, the cover unit guides the paper passed through the fixing unit to an inside of the discharging part. Accordingly, a guide rib is provided to the cover unit to guide the paper toward the discharging part. In addition, a rotatable guide member is mounted to the cover unit to guide the paper passed through the fixing unit such that a leading end of the paper is brought into contact with the guide rib of the cover unit at a relatively gentle angle.

However, when the auxiliary discharging part is opened by rotating the cover unit in order to discharge the paper through the auxiliary discharging part, the guide member of the cover unit is disposed on a paper advancing path. In this state, the leading end of the paper discharged through the auxiliary discharging part may interfere with the guide member, and therefore the paper may be deviated from the cover unit, failing to be stacked on the cover unit.

SUMMARY OF THE INVENTION

The present general inventive concept provides an image forming apparatus to prevent paper being discharged through an auxiliary discharging part from interfering with a guide member.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by an image forming apparatus including a main body, an auxiliary discharging part disposed at one side of the main body, a cover unit to open and close the auxiliary discharging part and to stack thereon paper discharged through the auxiliary discharging part, a guide member rotatably mounted to the cover unit to guide the paper when the paper is discharged through the auxiliary discharging part, and a supporting device to support the guide member when the auxiliary discharging part is in an opened state.

The cover unit may include a first cover having a lower end rotatably mounted at one side of the auxiliary discharging part of the main body, and a second cover mounted to the first cover to be movable back and forth, and the supporting device may support the guide member by operating in association with the back and forth movement of the second cover.

The auxiliary discharging part may guide the paper being discharged so that an image-formed side of the paper is directed upward.

The cover unit may further include a reversing guide that forms a reversing path along with the first cover to guide the paper in a reverse direction when duplex printing is performed. The supporting device may support the guide member against the reversing guide.

The supporting device may include a first link rotatably mounted to the first cover at one end thereof, and a second link having one end rotatably mounted to the other end of the first link, and another end rotatably mounted to the second cover.

The second cover may include a guide hole extending in a moving direction of the second cover so that the other end of the second link may move back and forth and rotate within the guide hole, and the second link may include a guide projection formed at the other end thereof rotatably mounted to the second cover to be inserted in the guide hole.

The first cover may include a penetration hole to allow the second link to protrude toward the guide member by passing through the first cover.

The supporting device may be provided in a pair to support both sides of the guide member.

The foregoing and/or other aspects and utilities of the general inventive concept may also be achieved by an image forming apparatus including a main body, an auxiliary discharging part formed at one side of the main body, a first cover having a lower end rotatably mounted to one side of the auxiliary discharging part of the main body, a second cover mounted to the first cover to be movable back and forth, a guide member rotatably mounted to the first cover to guide paper when the paper is discharged through the auxiliary discharging part, a reversing guide to form a reversing path along with the first cover to guide the paper in a reverse direction when duplex printing is performed, and a supporting device to support the guide member against the reversing guide by operating in association with the back and forth movement of the second cover.

The supporting device may include a first link rotatably mounted to the first cover at one end thereof, and a second link having one end rotatably mounted to the other end of the first link, and another end rotatably mounted to the second cover.

The foregoing and/or other aspects and utilities of the general inventive concept may also be achieved by an image forming apparatus including an auxiliary discharging part to discharge recording media outside of the image forming apparatus, and a cover unit rotatable to open and close the auxiliary discharging part and to receive the discharging recording media thereon, the cover unit including a first cover and a second cover, the second cover movable with respect to the first cover, and a guide member rotatable between a first position and a second position when the first cover is moved with respect to the second cover to interfere with the discharging recording media in the first position and not interfere with the discharging media in the second position.

The supporting device may support the guide member at the second position.

The supporting device may include a first link rotatably mounted to the first cover at one end thereof, and a second link having one end rotatably mounted to the other end of the first link, and another end rotatably mounted to the second cover.

The second cover may include a guide hole to allow the other end of the second link to move back and forth and rotate within the guide hole.

The first cover may include a penetration hole to allow the second link to protrude toward the guide member by passing through the first cover.

The guide member may be pivotably mounted to the first cover.

The cover unit may further include a reversing guide mounted to the first cover to form a reversing path along with the first cover to guide the discharging recording media in a reverse direction when the image forming apparatus performs duplex printing The image forming apparatus may further include a first rail part formed at both sides of the first cover, and a second rail part formed at both sides of the second cover, the second rail part being mounted to the first rail part to move the second cover back and forth along the first rail part.

The image forming apparatus may further include a plurality of guide ribs formed on the guide member, the first cover, and the second cover, to guide the discharging recording media.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
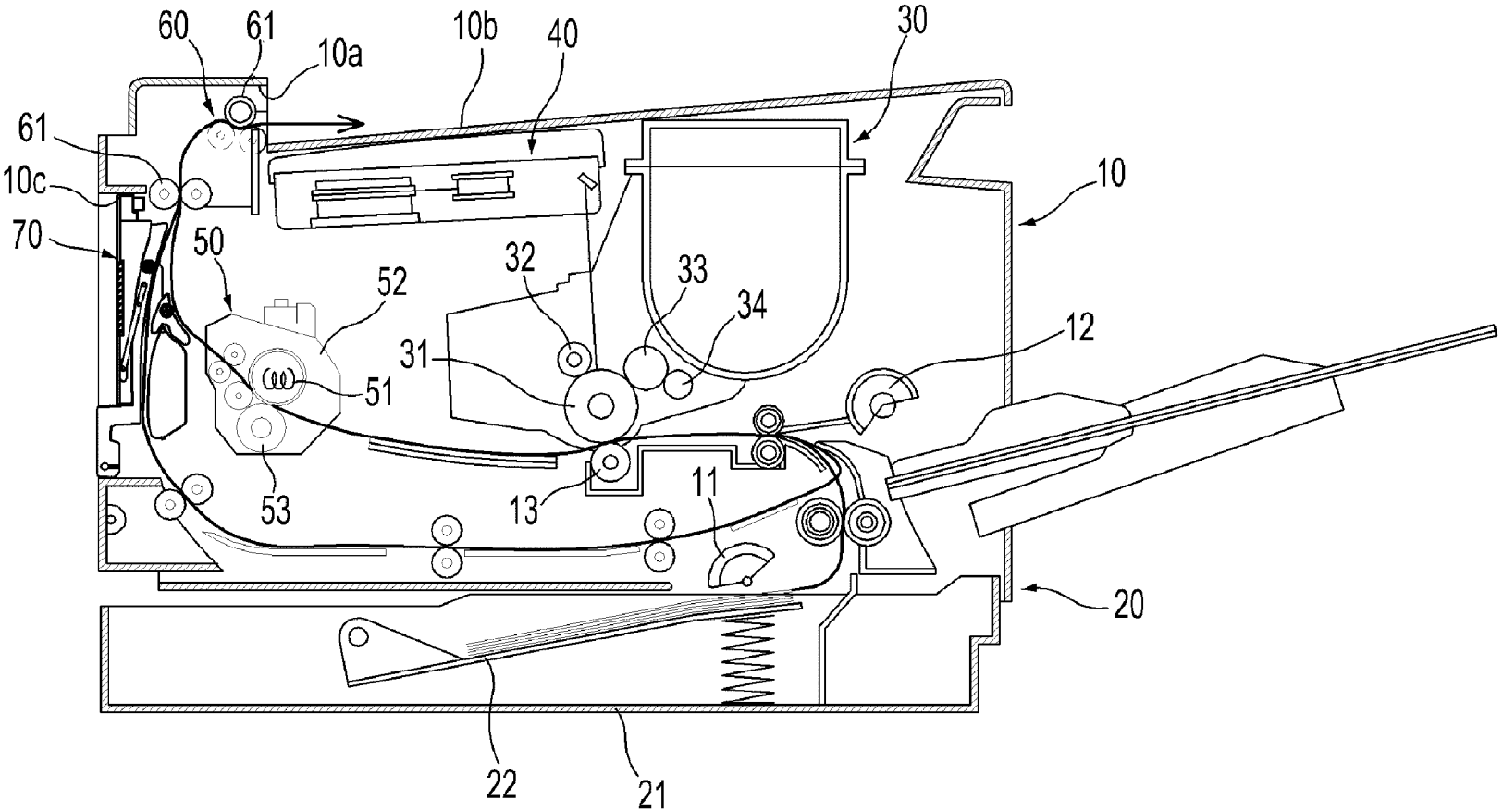
FIG. 1 is a sectional view schematically showing a structure of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
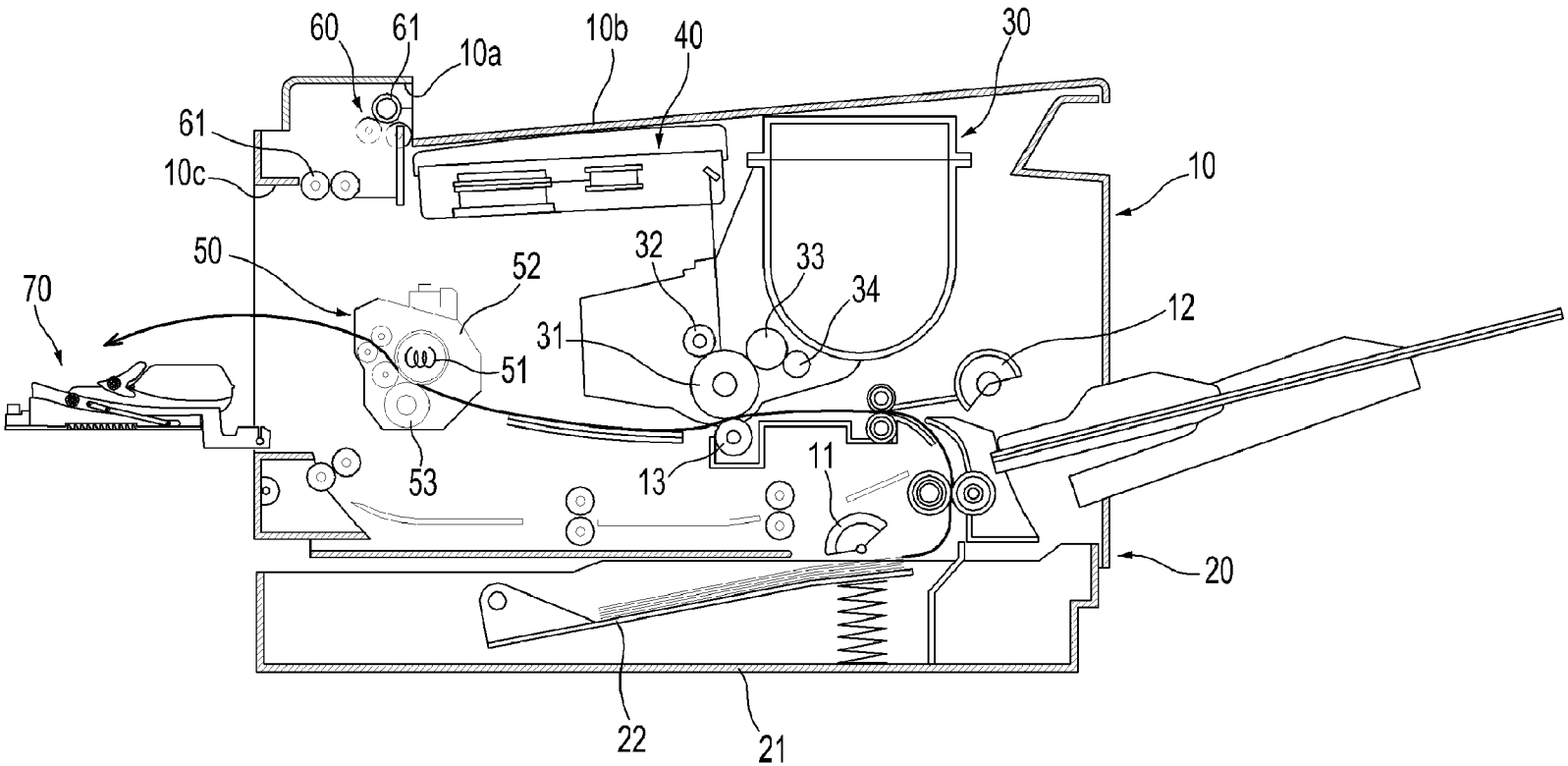
FIG. 2 is a section view schematically showing a structure of the image forming apparatus according to an embodiment of the present general inventive concept.

FIGS. 1 and 2 are section views schematically showing a structure of an image forming apparatus according to an embodiment of the present general inventive concept.

As shown in FIGS. 1 and 2, an image forming apparatus according to an embodiment of the present general inventive concept includes a main body 10 constituting the exterior appearance thereof, a paper feeding unit 20 to store paper therein and to feed the paper to be used, and a developing unit 30 to form a visible image using developer on the paper supplied by the paper feeding unit 20. The image forming apparatus also includes a laser scanning unit 40 to form an electrostatic latent image on a photoconductive medium 31 of the developing unit 30, a fixing unit 50 to fix the visible developer image transferred to the paper, and a paper discharging unit 60 to discharge the image-formed paper to the outside of the main body 10.

A paper stacking unit 10*b* is formed at one side of an upper part of the main body 10, including a discharging part 10*a* at one side to discharge the paper. An auxiliary discharging part 10*c* is additionally provided at one rear side of the main body 10 to guide the paper to be discharged with an image-formed side directed upward. A cover unit 70 is rotatably mounted to the auxiliary discharging part 10*c* at a lower end thereof to open and close the auxiliary discharging part 10*c* by rotating. When the auxiliary discharging part 10*c* is opened, the paper completing the image formation thereon, while passing through the fixing unit 50, is discharged through the auxiliary discharging part 10*c* while maintaining its posture and stacked on an upper part of the cover unit 70.

The paper feeding unit 20, which supplies the paper to the developing unit 30, includes a paper cassette 21 mounted to the main body 10 in the form of a detachable drawer and a knock-up plate 22 mounted within the paper cassette 21 to stack the paper thereon.

Inside the main body 10, there are mounted a pickup roller 11 that picks up the paper on the knock-up plate 22 sheet by sheet and a feed roller 12 that feeds the paper being picked up to the developing unit 30.

The developing unit 30 forms a developer image using developer. The developing unit 30 includes a photoconductive medium 31 to form an electrostatic latent image thereon by the laser scanning unit 40 and to function as an image carrier that holds the developer image thereon, and an electrifying roller 32 to electrify the photoconductive medium 31. The developing unit 30 also includes a developing medium 33 to supply developer to the photoconductive medium 31 and to develop the electrostatic latent image formed on the photoconductive medium 31 into the developer image, and a supplying roller 34 to supply developer to the developing medium 33.

The main body 10 further includes a transfer roller 13 that presses the paper toward the photoconductive medium 31 so that the developer image formed on the photoconductive medium 31 is transferred to the paper.

The laser scanning unit 40 forms the electrostatic latent image on the photoconductive medium 31 by emitting a laser beam containing image data.

The fixing unit 50 fixes the transferred developer image to the paper by applying heat and pressure to the paper. The fixing unit 50 includes a heating roller 52 to hold a heater 51 therein and a pressing roller 53 to press the paper toward the heating roller 52. As the paper passes between the heating roller 52 and the pressing roller 53, the transferred developer image is fixed to the paper.

The paper discharging unit 60 includes first discharging rollers 61 arranged in sequence to discharge the paper passed through the fixing unit 50 through the discharging part 10*a* to the paper stacking unit 10*b* disposed at the upper part of the main body 10.

Figure 3:
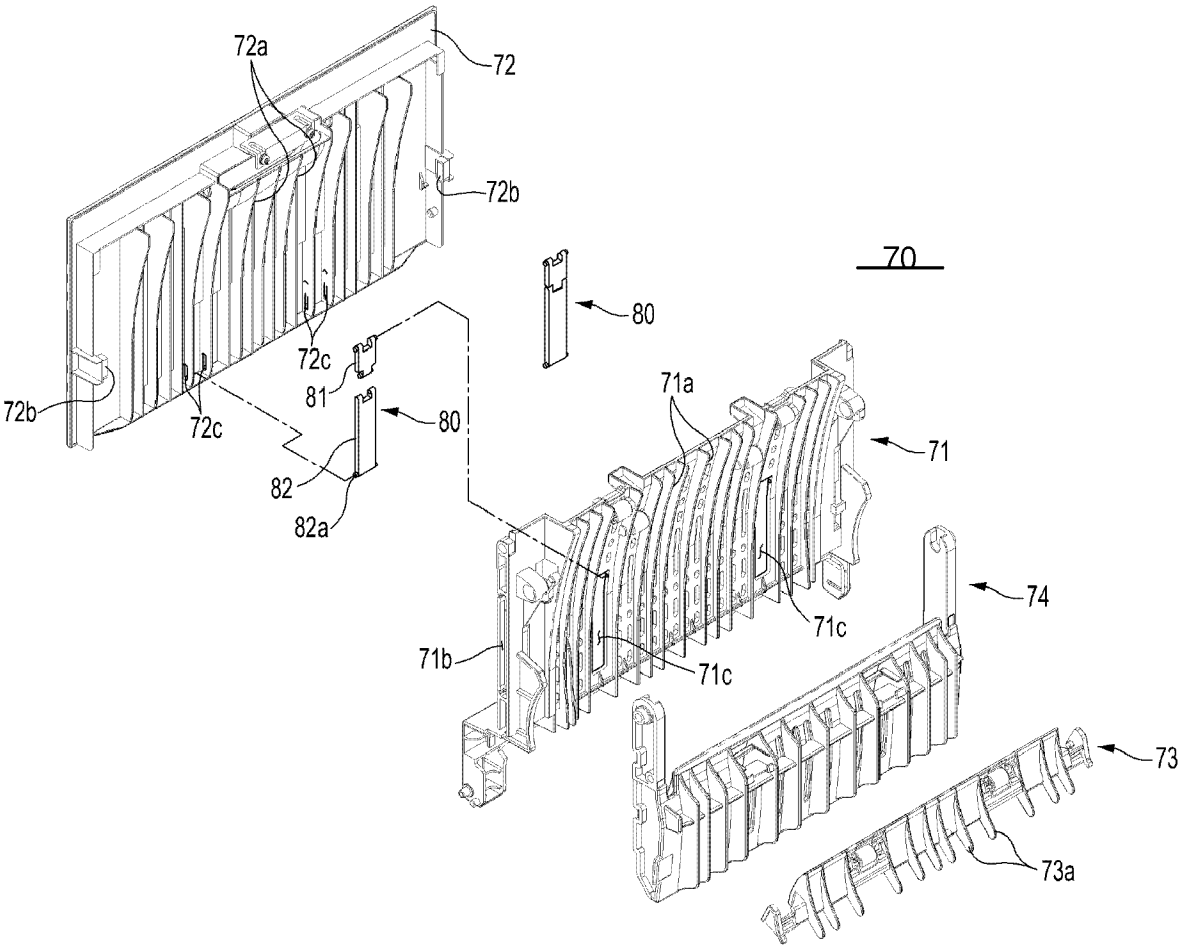
FIG. 3 is a sectional view of a cover unit employed in the image forming apparatus according to an embodiment of the present general inventive concept.

FIG. 3 is a sectional view of a cover unit employed in the image forming apparatus according to an embodiment of the present general inventive concept.

As shown in FIG. 3, the cover unit 70 includes a first cover 71 of which a lower end is pivotably mounted to the main body 10, and a second cover 72 movably mounted to the first cover 71 to stack the paper thereon along with the first cover 71 while moving back and forth. The cover unit 70 also includes a guide member 73 pivotably mounted to the first cover 71 and can be pivoted by a leading end of the paper when the paper is discharged, thereby guiding the paper to be brought into contact with the first cover 71 at a gradual angle. The cover unit 70 includes a reversing guide 74 mounted to the first cover 71 to form a reversing path along with the first cover 71 to guide the paper, one side of which is printed with the image in the case of duplex printing.

A first rail part 71*b* is formed on both sides of the first cover 71. The second cover 72 is mounted on the first rail part 71*b* to be movable back and forth. A second rail part 72*b* is formed on both sides of the second cover 72 and mounted to the first rail part 71*b* to be movable back and forth. A plurality of guide ribs 71*a*, 72*a* and 73*a* are provided at an inner side of the first cover 71, an inner side of the second cover 72, and the guide member 73, respectively, to each have a gradually curved section at a leading end thereof to guide the paper.

The cover unit 70 is equipped with a supporting device 80 that supports the guide member 73 while the paper is being discharged through the auxiliary discharging part 10*c*, and thereby prevents interference between the guide member 73 and the paper being discharged. More specifically, the supporting device 80 operates in association with the back and forth movement of the second cover 72, thereby supporting the guide member 73 against the reversing guide 74. A pair of the supporting devices 80 are provided on both sides of the cover unit 70 so that both sides of the guide member 73 are supported by the supporting devices 80, respectively.

Accordingly, the supporting device 80 includes a first link 81 of which one end is rotatably mounted at the first cover 71, and a second link 82 of which one end is rotatably mounted to the first link 81 and the other end is mounted at the second cover 72. The first link 81 and the second link 82 are connected at a connection part 81*a* and may rotate about the connection part 81*a*. The first link 81 and the second link 82 protrude toward the guide member 73 to support the guide member 73 against the reversing guide 74.

As illustrated in FIG. 3, the second cover 72 includes a guide hole 72*c* extending in a moving direction of the second cover 72 so that the other end of the second link 82 may move back and forth and rotate within the guide hole 72*c*. A guide projection 82*a* is formed at the other end of the second link 82 to be inserted in the guide hole 72*c* so that the guide projection 82*a* of the second link 82 may move back and forth and rotate along the guide hole 72*c*. The first cover 71 includes a penetration hole 71*c* to allow the first link 81 and the second link 82 to be interconnected by penetrating the first cover 71 and to allow the connection part 81*a* that connects the first link 81 and the second link 82 to protrude toward the guide member 73 by penetrating the first cover 71.

Hereinafter, the operation of the image forming apparatus according to an embodiment of the present general inventive concept will be explained. As shown in FIG. 1, the cover unit 70 is rotatably mounted to the auxiliary discharging part 10*c* to open and close the auxiliary discharging part 10*c*.

Figure 4:
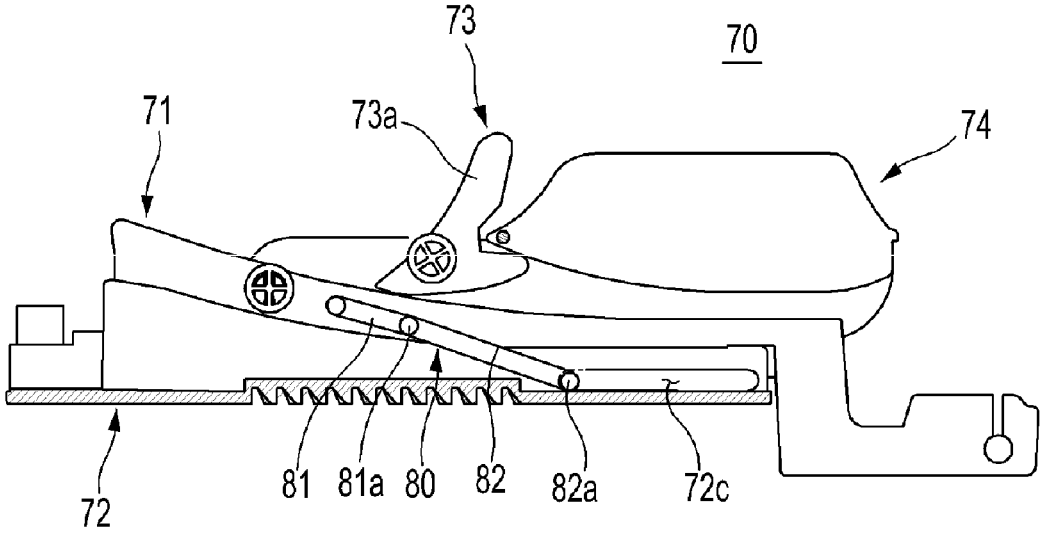
FIG. 4 is a side view schematically showing an operation of the cover unit and a supporting device employed in the image forming apparatus according to an embodiment of the present general inventive concept.
Figure 5:
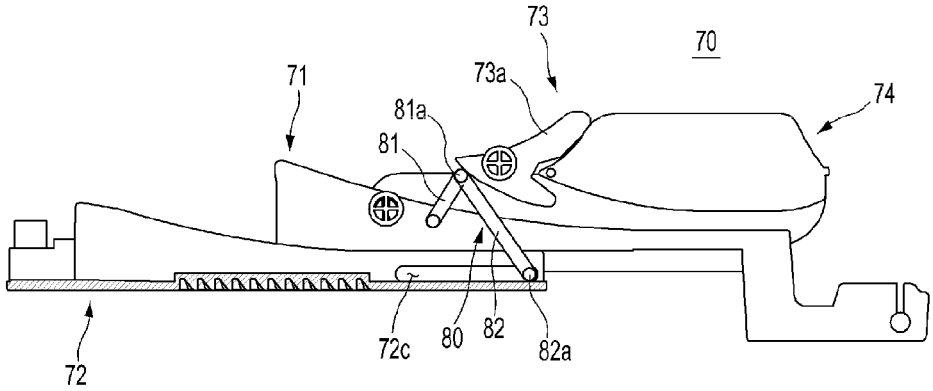
FIG. 5 is a side view schematically showing an operation of the cover unit and the supporting device employed in the image forming apparatus according to an embodiment of the present general inventive concept.

FIGS. 4 and 5 are side views schematically showing an operation of the cover unit 70 and a supporting device employed in the image forming apparatus according to an embodiment of the present general inventive concept.

As shown in FIG. 4, the cover unit 70 is rotated to an opened position so that the auxiliary discharging part 10*c* is opened. As described above, the second cover 72 includes the guide hole 72*c* to allow the guide projection 82*a* of the second link 82 to be inserted in the guide hole 72*c*, thereby allowing the second cover 72 to move back and forth as the guide projection 82*a* slides within the guide hole 72*c*.

As shown in FIGS. 3 and 5, when the second cover 72 is moved towards the first cover 71, the first and the second links 81 and 82 are rotated about the connection part 81*a*. Accordingly, the connection part 81*a* protrudes toward the guide member 73 through the penetration hole 71*c*, thereby supporting the guide member 73 so that the guide member 73 is supported against the reversing guide 74.

In this state, although the paper may be discharged through the auxiliary discharging part 10*c*, the leading end of the paper will not be able to enter between the guide member 73 and the reversing guide 74 since the guide member 73 is maintained in a state in which the guide member 73 is supported against the reversing guide 74. Therefore, the paper will not be interfered with by the guide member 73 and can be stably stacked on upper parts of the first cover 71 and the second cover 72.

Although the supporting device 80 according to the above described embodiment of the present general inventive concept operates in association with the back and forth movement of the second cover 72, other embodiments of the present general inventive concept are not limited to such a structure and may adopt various other structures. For example, an embodiment of the present general inventive concept may be structured such that the supporting device 80 may operate in association with the opening of the cover unit when the auxiliary discharging part 10*c* is opened by the cover unit 70.

According to the image forming apparatus in the above described embodiment of the present general inventive concept, since a guide member is supported by a supporting device when an auxiliary discharging part is in an opened state, the paper being discharged through the auxiliary discharging part may be stably stacked on a cover unit, preventing paper from being interfered with by the guide member.

Although various example embodiments of the present general inventive concept have been illustrated and described, it would be appreciated by those skilled in the art that changes may be made in these embodiments without departing from the principles and spirit of the general inventive concept invention, the scope of which is defined in the claims and their equivalents.

What is claimed is:

1. An image forming apparatus, comprising:

a main body;

an auxiliary discharging part disposed at one side of the main body;

a cover unit, including a first cover and a second cover which is movable with respect to the first cover, to open and close the auxiliary discharging part and to stack thereon paper discharged through the auxiliary discharging part;

a guide member rotatably mounted to the cover unit to guide the paper when the paper is discharged through the auxiliary discharging part; and a supporting device extending between and engaging the first cover and the second cover to support the guide member when the auxiliary discharging part is in an opened state, wherein the supporting device supports the guide member by coming into contact and rotating the guide member in response to the second cover moving relative to the first cover.

2. The image forming apparatus according to claim 1, wherein the first cover has a lower end rotatably mounted at one side of the auxiliary discharging part of the main body, and the second cover is mounted to the first cover to be movable back and forth, and the supporting device supports the guide member by operating in association with the back and forth movement of the second cover.

3. The image forming apparatus according to claim 1, wherein the auxiliary discharging part guides the paper being discharged so that an image-formed side of the paper is directed upward.

4. The image forming apparatus according to claim 2, wherein the cover unit further comprises a reversing guide that forms a reversing path along with the first cover to guide the paper in a reverse direction when duplex printing is performed, and the supporting device supports the guide member against the reversing guide.

5. The image forming apparatus according to claim 2, wherein the supporting device comprises:

a first link rotatably mounted to the first cover at one end of the first link; and a second link having one end rotatably mounted to the other end of the first link and another end rotatably mounted to the second cover.

6. The image forming apparatus according to claim 5, wherein the second cover comprises a guide hole extending in a moving direction of the second cover so that the other end of the second link may move back and forth and rotate within the guide hole, and the second link comprises a guide projection formed at the other end thereof rotatably mounted to the second cover to be inserted in the guide hole.

7. The image forming apparatus according to claim 5, wherein the first cover comprises a penetration hole to allow the second link to protrude toward the guide member by passing through the first cover.

8. The image forming apparatus according to claim 1, wherein the supporting device is provided in a pair to support both sides of the guide member.

9. An image forming apparatus, comprising:

a main body;

an auxiliary discharging part formed at one side of the main body;

a first cover having a lower end rotatably mounted to one side of the auxiliary discharging part of the main body;

a second cover mounted to the first cover to be movable back and forth;

a guide member rotatably mounted to the first cover to guide paper when the paper is discharged through the auxiliary discharging part;

a reversing guide to form a reversing path along with the first cover to guide the paper in a reverse direction when duplex printing is performed; and a supporting device extending between and engaging the first cover and the second cover to support the guide member against the reversing guide by operating in association with the back and forth movement of the second cover, wherein the supporting device supports the guide member by coming into contact and rotating the guide member in response to the second cover moving relative to the first cover.

10. The image forming apparatus according to claim 9, wherein the supporting device comprises:

a first link rotatably mounted to the first cover at one end of the first link; and a second link having one end rotatably mounted to the other end of the first link and another end rotatably mounted to the second cover.

11. An image forming apparatus, comprising:

an auxiliary discharging part to discharge recording media outside of the image forming apparatus; and a cover unit rotatable to open and close the auxiliary discharging part and to receive the discharging recording media thereon, the cover unit including:

a first cover and a second cover, the second cover movable with respect to the first cover;

a guide member rotatable between a first position and a second position when the second cover is moved with respect to the first cover to interfere with the discharging recording media in the first position and not interfere with the discharging recording media in the second position; and a supporting device extending between and engaging the first cover and the second cover to support the guide member at the second position, wherein the supporting device supports the guide member by coming into contact and rotating the guide member in response to the second cover moving relative to the first cover.

12. The image forming apparatus according to claim 11, wherein the supporting device comprises:

a first link rotatably mounted to the first cover at one end of the first link; and a second link having one end rotatably mounted to the other end of the first link and another end rotatably mounted to the second cover.

13. The image forming apparatus according to claim 12, wherein the second cover includes a guide hole to allow the other end of the second link to move back and forth and rotate within the guide hole.

14. The image forming apparatus according to claim 12, wherein the first cover includes a penetration hole to allow the second link to protrude toward the guide member by passing through the first cover.

15. The image forming apparatus according to claim 11, wherein the guide member is pivotably mounted to the first cover.

16. The image forming apparatus according to claim 11, wherein the cover unit further comprises:

a reversing guide mounted to the first cover to form a reversing path along with the first cover to guide the discharging recording media in a reverse direction when the image forming apparatus performs duplex printing.

17. The image forming apparatus according to claim 11, wherein a first rail part is formed at both sides of the first cover, and a second rail part is formed at both sides of the second cover, the second rail part being mounted to the first rail part to move the second cover back and forth along the first rail part.

18. The image forming apparatus according to claim 11, wherein a plurality of guide ribs are formed on the guide member, the first cover, and the second cover, to guide the discharging recording media.

* * * * *